US011850854B2

(12) United States Patent
Mou et al.

(10) Patent No.: US 11,850,854 B2
(45) Date of Patent: Dec. 26, 2023

(54) WAFER STRUCTURE

(71) Applicant: Microjet Technology Co., Ltd., Hsinchu (TW)

(72) Inventors: Hao-Jan Mou, Hsinchu (TW); Ying-Lun Chang, Hsinchu (TW); Hsien-Chung Tai, Hsinchu (TW); Yung-Lung Han, Hsinchu (TW); Chi-Feng Huang, Hsinchu (TW); Wei-Ming Lee, Hsinchu (TW)

(73) Assignee: MICROJET TECHNOLOGY CO., LTD., Hsinchu (TW)

( * ) Notice: Subject to any disclaimer, the term of this patent is extended or adjusted under 35 U.S.C. 154(b) by 79 days.

(21) Appl. No.: 17/473,276

(22) Filed: Sep. 13, 2021

(65) Prior Publication Data

US 2022/0161559 A1 May 26, 2022

(30) Foreign Application Priority Data

Nov. 24, 2020 (TW) ..... 109141080

(51) Int. Cl.
*B41J 2/14* (2006.01)

(52) U.S. Cl.
CPC ..... *B41J 2/14145* (2013.01); *B41J 2/14072* (2013.01); *B41J 2202/11* (2013.01)

(58) Field of Classification Search
CPC ..... B41J 2/14145; B41J 2/14072; B41J 2/14129; B41J 2/1404; B41J 2/1632; B41J 2/1646; B41J 2/1601; B41J 2/1603; B41J 2/0458; B41J 2/145; B41J 2/1631; B41J 2202/11; B41J 2002/14459; B41J 2/04541; B41J 2/1635
See application file for complete search history.

(56) References Cited

U.S. PATENT DOCUMENTS

2014/0118441 A1* 5/2014 Lambright ..... B41J 2/1404 347/40
2016/0207264 A1* 7/2016 Liao ..... B41J 2/17546

FOREIGN PATENT DOCUMENTS

TW 200707526 A 2/2007
TW 201238779 A1 10/2012
TW 201827244 A 8/2018

OTHER PUBLICATIONS

Replacing Semiconductor chips in a full-width chip array, Quinn et al., col. 7 lines 7-40 (Year: 1996).*
IP.com search (Year: 2023).*

* cited by examiner

*Primary Examiner* — Lisa Solomon
(74) *Attorney, Agent, or Firm* — Birch, Stewart, Kolasch & Birch, LLP

(57) ABSTRACT

A wafer structure is disclosed and includes a chip substrate and an inkjet chip. The chip substrate is a silicon substrate fabricated by a semiconductor process on a wafer of 12 inches. The inkjet chips are formed on the chip substrate by the semiconductor process and diced into the inkjet chip. The inkjet chip includes plural ink-drop generators generated by the semiconductor process on the chip substrate. Each of the plurality of ink-drop generators includes a nozzle. A diameter of the nozzle is in a range between 0.5 micrometers and 10 micrometers. A volume of an inkjet drop discharged from the nozzle is in a range between 1 femtoliter and 3 picoliters. The ink-drop generators form plural longitudinal axis array groups having a pitch and plural horizontal axis array groups having a central stepped pitch equal to or less than 1/600 inches.

20 Claims, 9 Drawing Sheets

WAFER STRUCTURE

FIELD OF THE INVENTION

The present disclosure relates to a wafer structure, and more particularly to a wafer structure fabricated by a semiconductor process and applied to an inkjet chip for inkjet printing.

BACKGROUND OF THE INVENTION

In addition to a laser printer, an inkjet printer is another model that is commonly and widely used in the current market of the printers. The inkjet printer has the advantages of low price, easy to operate and low noise. Moreover, the inkjet printer is capable of printing on various printing media, such as paper and photo paper. The printing quality of an inkjet printer mainly depends on the design factors of an ink cartridge. In particular, the design factor of an inkjet chip releasing ink droplets to the printing medium is regarded as an important consideration in the design factors of the ink cartridge.

In addition, as the inkjet chip was pursuing the requirements of printing quality for higher resolution and higher printing speed, the price of the inkjet printer also dropped very fast in the highly competitive inkjet printing market. Therefore, the manufacturing cost of the inkjet chip combined with the ink cartridge and the design cost of higher resolution and higher printing speed thereof become key factors that determine market competitiveness.

However, the inkjet chip produced in the current inkjet printing market is made from a wafer structure by a semiconductor process. The conventional inkjet chip is all fabricated with the wafer structure of less than 6 inches. Under the requirement of pursuing higher resolution and higher printing speed at the same time, the design of the printing swath of the inkjet chip needs to be larger and longer, so as to greatly increase the printing speed. In this way, the overall area required for the inkjet chip becomes larger. Therefore, the number of inkjet chips required to be manufactured on a wafer structure within a limited area of less than 6 inches becomes quite limited, and the manufacturing cost also cannot be effectively reduced.

For example, the printing swath of an inkjet chip produced from a wafer structure of less than 6 inches is 0.56 inches, and can be diced to generate 334 inkjet chips at most. Furthermore, if the inkjet chip having the printing swath more than 1 inch or meeting the printing swath of one A4 page width (8.3 inches) is obtained with the printing quality requirements of higher resolution and higher printing speed in the wafer structure of less than 6 inches, the number of required inkjet chips produced on the wafer structure within the limited area less than 6 inches is quite limited, and the obtained number thereof is even smaller. This will result in waste of remaining blank area on the wafer structure with the limited area of less than 6 inches, which occupy more than 20% of the entire area of the wafer structure, and it is quite wasteful. Furthermore, the manufacturing cost cannot be effectively reduced.

Therefore, how to meet the object of pursuing lower manufacturing cost of the inkjet chip in the inkjet printing market, higher resolution, and higher printing speed is a main issue of concern developed in the present disclosure.

SUMMARY OF THE INVENTION

An object of the present disclosure is to provide a wafer structure including a chip substrate and a plurality of inkjet chips. The chip substrate is fabricated by a semiconductor process on a wafer of at least 12 inches or more, so that more required inkjet chips can be arranged on the chip substrate, and arranged in a printing inkjet lay-out design of higher resolution and higher performance. On the other hand, the inkjet chips having different sizes in response to different printing swath are required, and the inkjet chips on the chip substrate are diced according to the requirements of the applications. It is helpful to reduce the restriction of the chip substrate for the inkjet chips, and reduce the unused area on the chip substrate. Consequently, the utilization of the chip substrate is improved, the vacancy rate of the chip substrate is reduced, and the manufacturing cost is reduced. At the same time, the pursuit of printing quality for higher resolution and higher printing speed can be achieved.

In accordance with an aspect of the present disclosure, a wafer structure is provided and includes a chip substrate and at least one inkjet chip. The chip substrate is a silicon substrate fabricated by a semiconductor process on a wafer of at least 12 inches. The at least one inkjet chip is directly formed on the chip substrate by the semiconductor process, and is diced into at least one inkjet chip for inkjet printing. The inkjet chip includes a plurality of ink-drop generators generated by the semiconductor process on the chip substrate. Each of the plurality of ink-drop generators includes a nozzle. A diameter of the nozzle is in a range between 0.5 micrometers and 10 micrometers. A volume of an inkjet drop discharged from the nozzle is in a range between 1 femtoliter and 3 picoliters. In the inkjet chip, the plurality of ink-drop generators are arranged in a longitudinal direction to form a plurality of longitudinal axis array groups with a pitch maintained between two adjacent ink-drop generators in the longitudinal direction, and the ink-drop generators are arranged in a horizontal direction to form a plurality of horizontal axis array groups having a central stepped pitch maintained between two adjacent ink-drop generators in the horizontal direction. The central stepped pitch is at least equal to 1/600 inches or less.

BRIEF DESCRIPTION OF THE DRAWINGS

The above contents of the present disclosure will become more readily apparent to those ordinarily skilled in the art after reviewing the following detailed description and accompanying drawings, in which.

DETAILED DESCRIPTION OF THE PREFERRED EMBODIMENT

The present disclosure will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
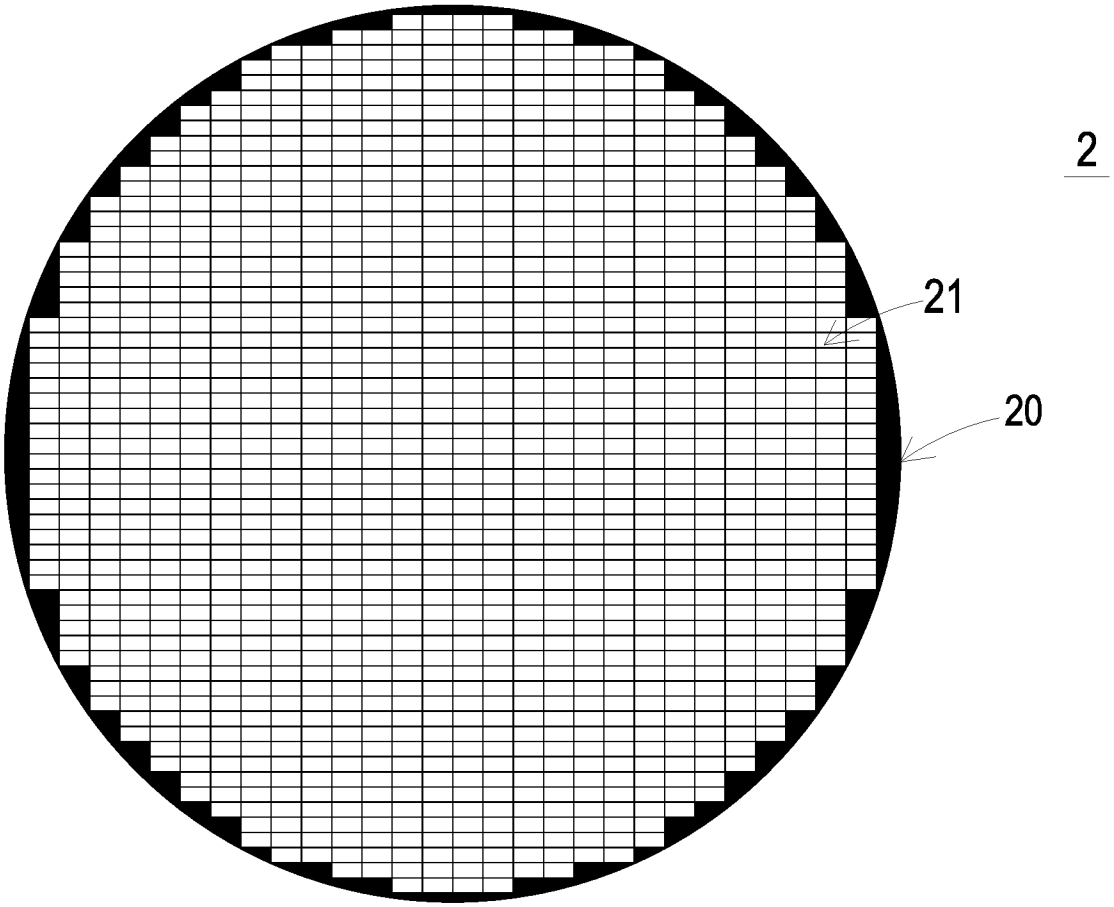
FIG. 1 is a schematic view illustrating a wafer structure according to an embodiment of the present disclosure.
Figure 2:
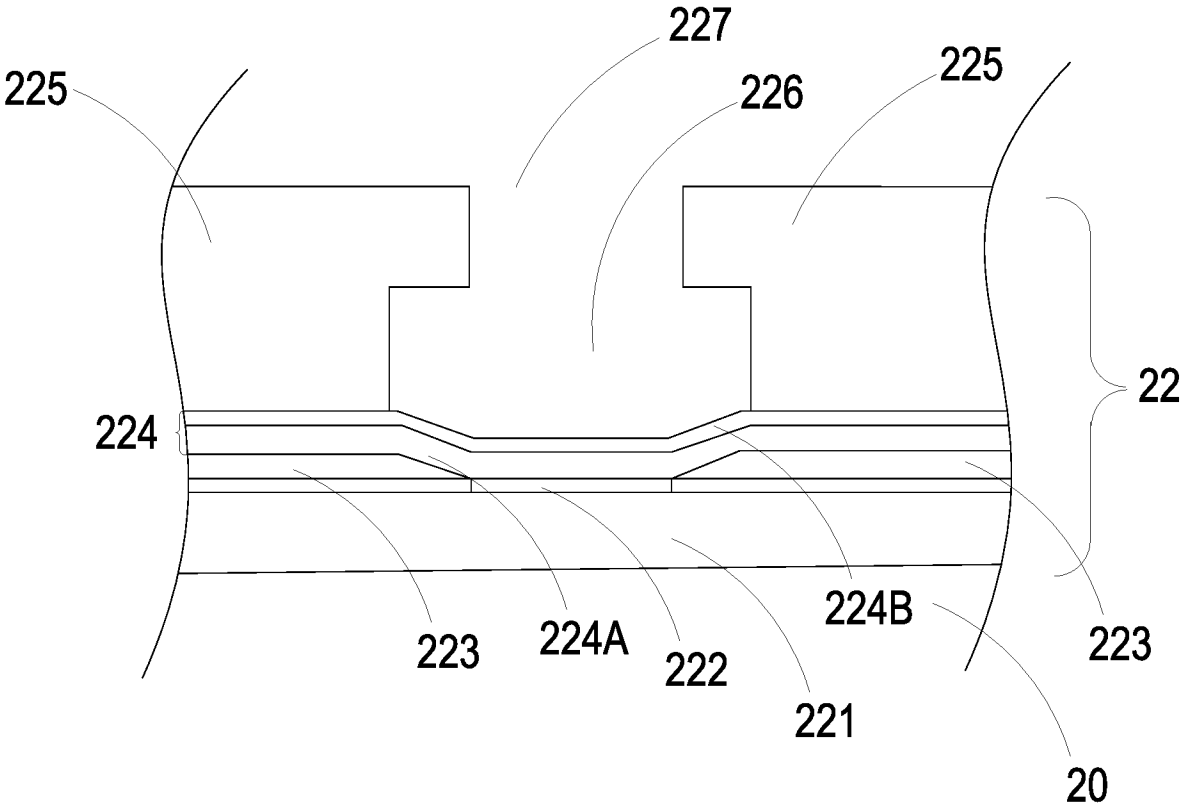
FIG. 2 is a schematic cross-sectional view illustrating the ink-drop generators on the wafer structure according to the embodiment of the present disclosure.

Please refer to FIG. 1 and FIG. 2. The present disclosure provides a wafer structure 2. The wafer structure 2 includes a chip substrate 20 and a plurality of inkjet chips 21. Preferably but not exclusively, the chip substrate 20 is a silicon substrate and fabricated by a semiconductor process on a wafer of at least 12 inches. In an embodiment, the chip substrate 20 is fabricated by the semiconductor process on a 12-inch wafer. In another embodiment, the chip substrate 20 is fabricated by the semiconductor process on a 16-inch wafer, but not limited thereto.

In the embodiment, each of the inkjet chips 21 includes a plurality of ink-drop generators 22, respectively. The plurality of ink-drop generators 22 are formed by the semiconductor process on the chip substrate 20. Moreover, the plurality of inkjet chips 21 on the chip substrate 20 are diced into at least one inkjet chip. As shown in FIG. 2, each of the ink-drop generators 22 includes a thermal-barrier layer 221, a resistance heating layer 222, a conductive layer 223, a protective layer 224, a barrier layer 225, an ink-supply chamber 226 and a nozzle 227. In the embodiment, the thermal-barrier layer 221 is formed on the chip substrate 20. The resistance heating layer 222 is formed on the thermal-barrier layer 221. The conductive layer 223 and a part of the protective layer 224 are formed on the resistance heating layer 222. The rest part of the protective layer 224 is formed on the conductive layer 223. The barrier layer 225 is formed on the protective layer 224. Moreover, the ink-supply chamber 226 and the nozzle 227 are integrally formed in the barrier layer 225. In the embodiment, a bottom of the ink-supply chamber 226 is in communication with the protective layer 224. The top of the ink-supply chamber 226 is in communication with the nozzle 227. A diameter of the nozzle 227 is in a range between 0.5 micrometers (μm) and 10 micrometers (μm). The ink in the ink-supply chamber 226 is heated by the resistance heating layer 222, generates a hot bubble, and pushes the ink to be discharged from the nozzle 227 and form an inkjet drop. A volume of the inkjet drop is in a range between 1 femtoliter and 3 picoliters. The ink-drop generator 22 of the inkjet chip 21 is fabricated by performing the semiconductor process on the chip substrate 20 as described below. Firstly, a thin film of the thermal-barrier layer 221 is formed on the chip substrate 20, and the resistance heating layer 222 and the conductive layer 223 are successively disposed thereon by sputtering, and the required size is defined by the process of photolithography. Afterwards, the protective layer 224 is coated thereon through a sputtering device or a chemical vapor deposition (CVD) device. Then, the ink-supply chamber 226 is formed on the protective layer 224 by compression molding of a polymer film, and the nozzle 227 is formed by compression molding of a polymer film coated thereon, so as to integrally form the barrier layer 225 on the protective layer 224. In this way, the ink-supply chamber 226 and the nozzle 227 are integrally formed in the barrier layer 225. Alternatively, in another embodiment, a polymer film is formed on the protective layer 224 to directly define the ink-supply chamber 226 and the nozzle 227 by a photolithography process. In this way, the ink-supply chamber 226 and the nozzle 227 are also integrally formed in the barrier layer 225. The bottom of the ink-supply chamber 226 is in communication with the protective layer 224, and the top of the ink-supply chamber 226 is in communication with the nozzle 227. In the embodiment, the chip substrate 20 is a silicon substrate. The resistance heating layer 222 is made of a tantalum aluminide (TaAl) material. The conductive layer 223 is made of an aluminum (Al) material. The protective layer 224 is formed by stacking a second protective layer 224B as an under layer and a first protective layer 224A as an under layer. The first protective layer 224A is made of a silicon nitride ($Si_3N_4$) material. The second protective layer 224B is made of a silicon carbide (SiC) material. The barrier layer 225 is made of a polymer material.

Figure 3A:
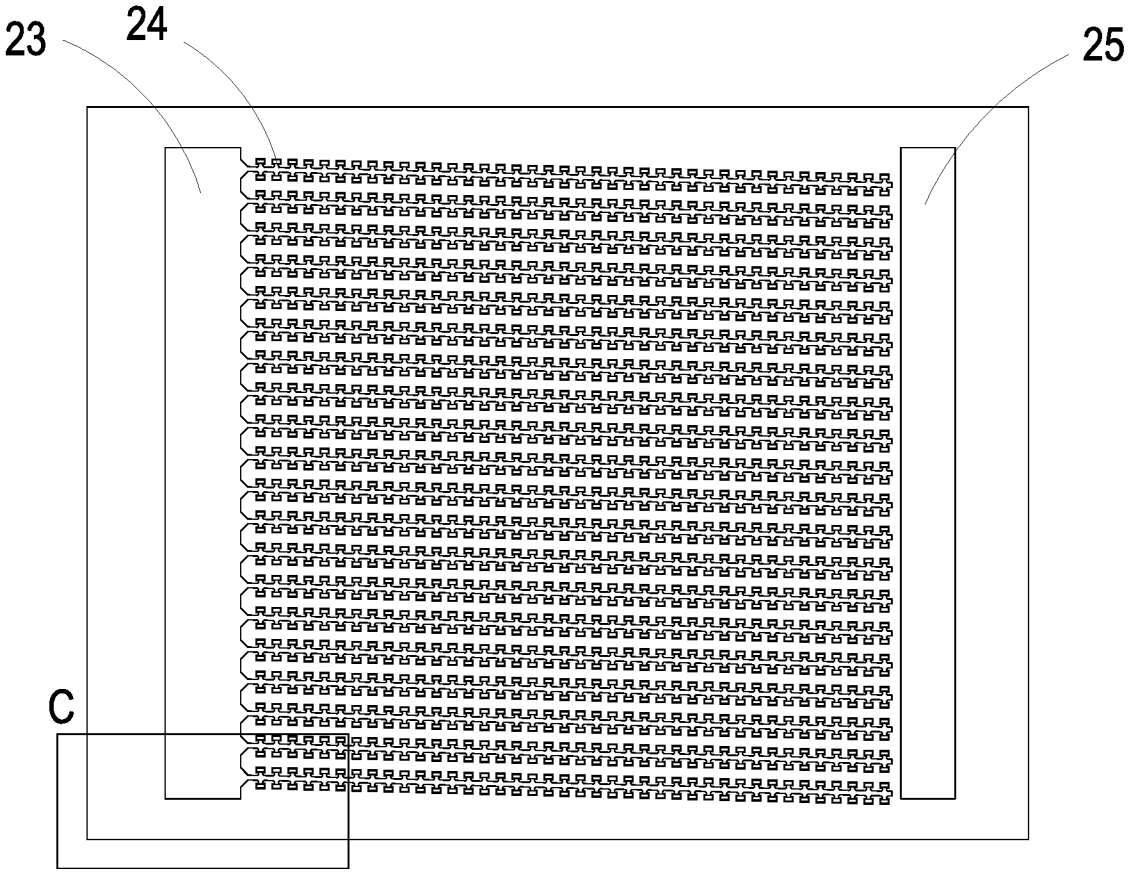
FIG. 3A is a schematic view illustrating the ink-supply channels, the manifolds and the ink-supply chamber arranged on the inkjet chip of the wafer structure according to the embodiment of the present disclosure.
Figure 3B:
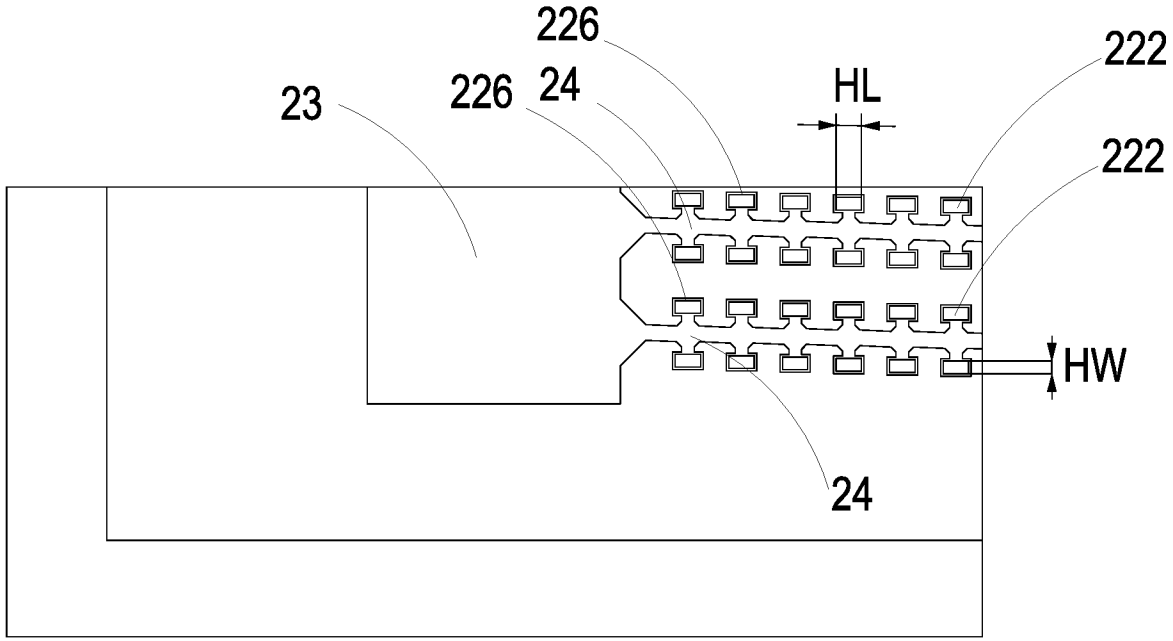
FIG. 3B is a partial enlarged view illustrating the region C of FIG. 3A.

Certainly, in the embodiment, the ink-drop generator 22 of the inkjet chip 21 is fabricated by the semiconductor process on the chip substrate 20. Furthermore, in the process of defining the required size by the lithographic etching process, as shown in FIGS. 3A to 3B, at least one ink-supply channel 23 and a plurality of manifolds 24 are defined. Then, the ink-supply chamber 226 is formed on the protective layer 224 by dry film compression molding, and a dry film is coated to form the nozzle 227 by dry film compression molding, so that the barrier layer 225 is integrally formed on the protective layer 224 as shown in FIG. 2. Moreover, the ink-supply chamber 226 and the nozzle 227 are integrally formed in the barrier layer 225. In the embodiment, the bottom of the ink-supply chamber 226 is in communication with the protective layer 224, and the top of the ink-supply chamber 226 is in communication with the nozzle 227. The plurality of nozzles 227 are directly exposed on the surface of the inkjet chip 21 and arranged in the required lay-out, as shown in FIG. 3D. Therefore, the ink-supply channels 23 and the plurality of manifolds 24 are also fabricated by the semiconductor process at the same time. Each of the plurality of ink-supply channels 23 provides ink, and the ink-supply channel 23 is in communication with the plurality of manifolds 24. Moreover, the plurality of manifolds 24 are in communication with each of the ink-supply chambers 226 of the ink-drop generators 22. As shown in FIG. 3B, the resistance heating layer 222 is formed and exposed in the ink-supply chamber 226. The resistance heating layer 222 has a rectangular area with a length HL and a width HW.

Figure 3C:
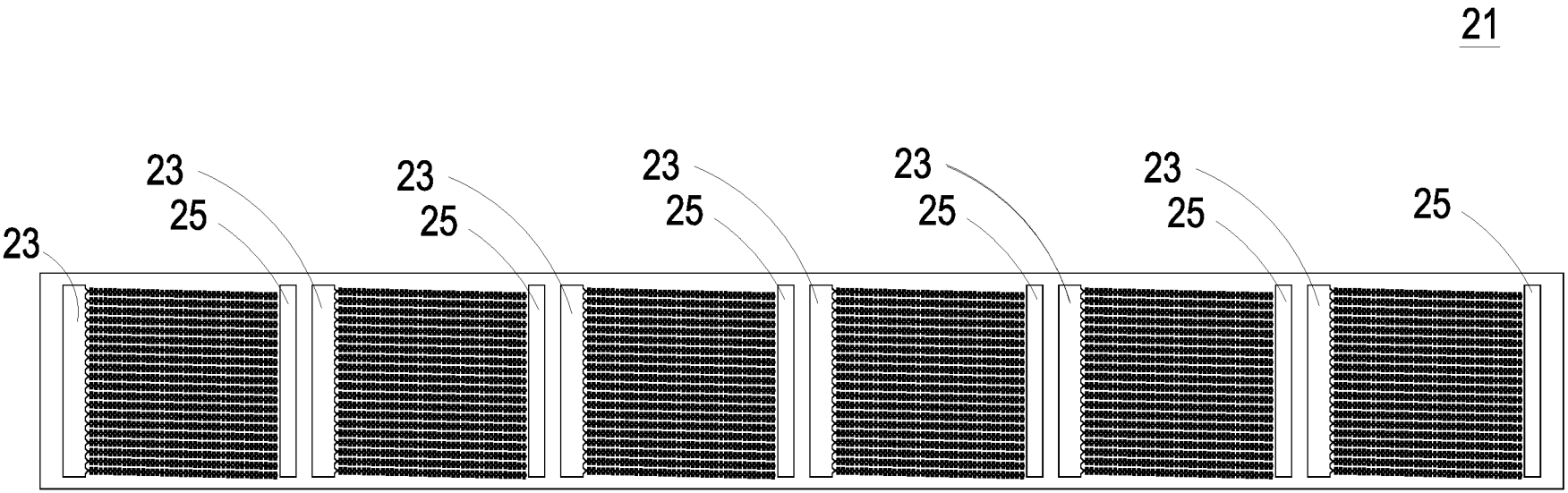
FIG. 3C is a schematic view illustrating the ink-supply channels and the elements of the conductive layer arranged on the inkjet chip of the wafer structure according to another embodiment of the present disclosure.
Figure 3D:
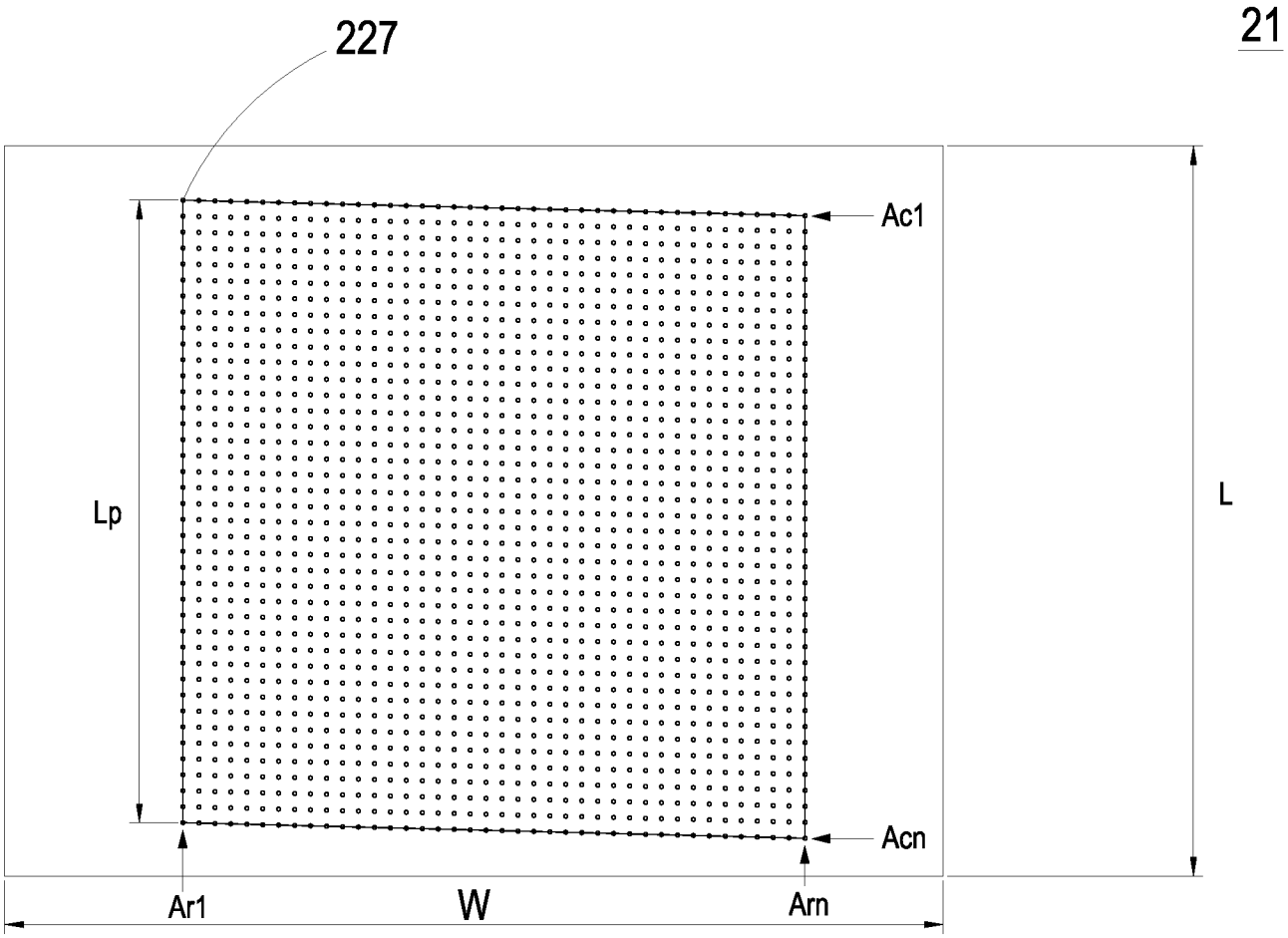
FIG. 3D is a schematic view illustrating the nozzles formed and arranged on the inkjet chip of FIG. 3A according to the embodiment of the present disclosure.

Please refer to FIGS. 3A and 3C. The number of the at least one ink-supply channel 23 may be at least one to six. As shown in FIG. 3A, the number of the at least one ink-supply channel 23 arranged on a single inkjet chip 21 is one, thereby providing monochrome ink. Preferably but not exclusively, the monochrome ink is selected from the group consisting of cyan, magenta, yellow and black ink. As shown in FIG. 3C, the number of the at least one ink-supply channel 23 arranged on a single inkjet chip 21 is six, thereby providing six-color ink of black, cyan, magenta, yellow, light cyan and light magenta, respectively. Certainly, in other embodiments, the number of the at least one ink-supply channel 23 arranged on a single inkjet chip 21 may be four, thereby providing four-color ink of cyan, magenta, yellow and black, respectively. The number of the ink-supply channels 23 is adjustable and can be designed according to the practical requirements.

Figure 4:
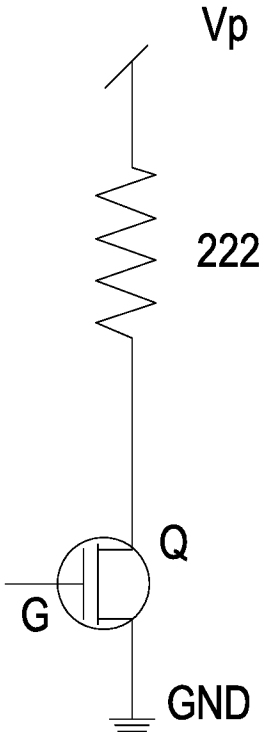
FIG. 4 is a schematic view illustrating the circuit diagram for heating the resistance heating layer under the control and excitement of the conductive layer according to the embodiment of the present disclosure.

Please refer to FIG. 3A, FIG. 3C and FIG. 4. In the embodiment, the conductive layer 223 is fabricated by the semiconductor process on the wafer structure 2. Preferably but not exclusively, the conductors connected in the conductive layer 223 is fabricated by the semiconductor process of less than 90 nanometers to form an inkjet control circuit. In that, more metal oxide semiconductor field-effect transistors (MOSFETs) are arranged in the inkjet control circuit zone 25 to control the resistance heating layer 222. Therefore, the resistance heating layer 222 is activated for heating as the circuit is conducted. Alternatively, the resistance heating layer 222 is not activated for heating as the circuit is not conducted. That is, as shown in FIG. 4, when a voltage Vp is applied to the resistance heating layer 222, the transistor switch Q controls the circuit state of the resistance heating layer 222 grounded. When one end of the resistance heating layer 222 is grounded, a circuit is conducted to activate the resistance heating layer 222 for heating. Alternatively, if the circuit is not conducted, the resistance heating layer 22 is not grounded and not activated for heating. Preferably but not exclusively, the transistor switch Q is a metal oxide semiconductor field effect transistor (MOSFET), and the conductor connected by the conductive layer 223 is a gate G of the metal oxide semiconductor field effect transistor (MOSFET). In other embodiment, the conductor connected by the conductive layer 223 is a gate G of a complementary metal oxide semiconductor (CMOS). In another embodiment, the conductive layer 223 is connected to a conductor, and the conductor is a gate G of an N-type metal oxide semiconductor (NMOS), but not limited thereto. The conductor connected by the conductive layer 223 is adjustable and can be selected according to the practical requirements for the inkjet control circuit. Certainly, in an embodiment, the conductor connected by the conductive layer 223 is fabricated by the semiconductor process of 65 nanometers to 90 nanometers, to form the inkjet control circuit. In an embodiment, the conductor connected by the conductive layer 223 is fabricated by the semiconductor process of 45 nanometers to 65 nanometers, to form the inkjet control circuit. In an embodiment, the conductor connected by the conductive layer 223 is fabricated by the semiconductor process of 28 nanometers to 45 nanometers, to form the inkjet control circuit. In an embodiment, the conductor connected by the conductive layer 223 is fabricated by the semiconductor process of 20 nanometers to 28 nanometers, to form the inkjet control circuit. In an embodiment, the conductor connected by the conductive layer 223 is fabricated by the semiconductor process of 12 nanometers to 20 nanometers, to form the inkjet control circuit. In an embodiment, the conductor connected by the conductive layer 223 is fabricated by the semiconductor process of 7 nanometers to 12 nanometers, to form the inkjet control circuit. In an embodiment, the conductor connected by the conductive layer 223 is fabricated by the semiconductor process of 2 nanometers to 7 nanometers, to form the inkjet control circuit. It is understandable that the more sophisticated the semiconductor process technology is, the more groups of inkjet control circuits can be fabricated within the same unit volume.

As described above, the present disclosure provides the wafer structure 2 including the chip substrate 20 and the plurality of inkjet chips 21. The chip substrate 20 is fabricated by the semiconductor process on a wafer of at least 12 inches or more, so that a larger number of required inkjet chips 21 can be arranged on the chip substrate 20. The restriction of the chip substrate 20 for the inkjet chips 21 can be reduced. Moreover, the unused area on the chip substrate 20 can be reduced, so as to improve the utilization of the chip substrate 20 and reduce the vacancy rate and the manufacturing cost of the chip substrate 20. At the same time, the pursuit of printing quality for higher resolution and higher printing speed is achieved.

The design of the resolution and the sizes of printing swath of the inkjet chip 21 are described below.

Figure 5:
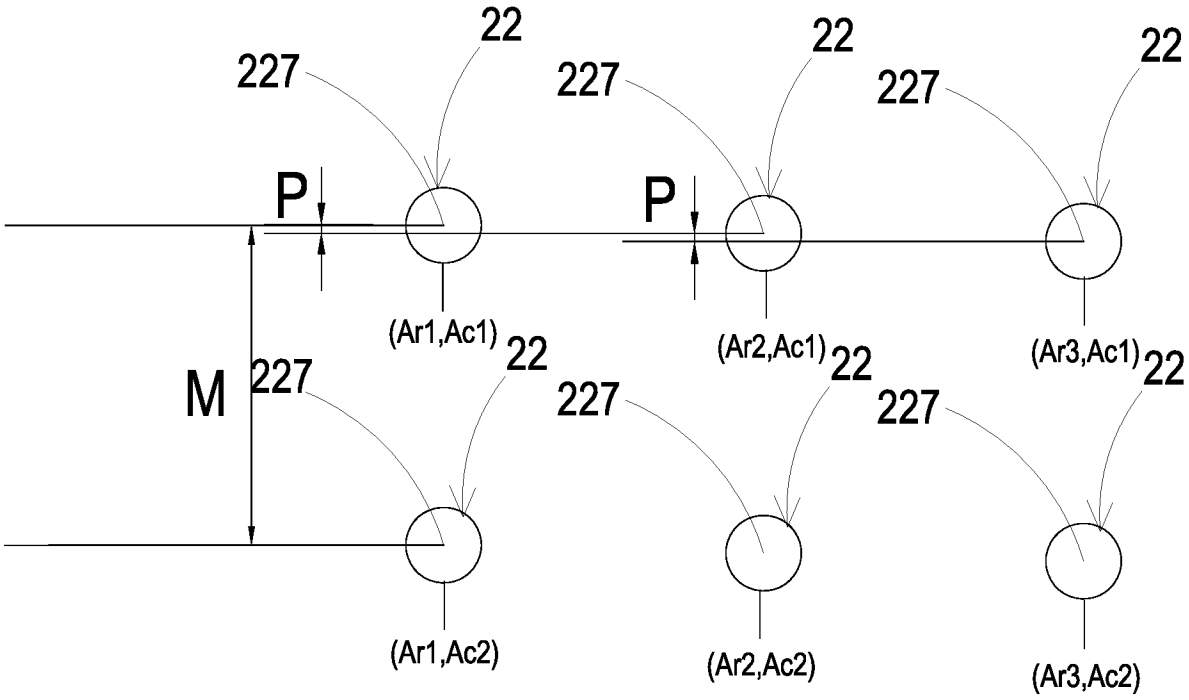
FIG. 5 is an enlarged view illustrating the ink-drop generators formed and arranged on the wafer structure according to the embodiment of the present disclosure.

As shown in FIGS. 3D and 5, each of the inkjet chips 21 includes a rectangular area with a length L and a width W, and a printing swath Lp. In the embodiment, each of inkjet chips 21 includes a plurality of ink-drop generators 22. The plurality of ink-drop generators 22 are produced by the semiconductor process and formed on the chip substrate 20. In the inkjet chips 21, the plurality of ink-drop generators 22 are arranged in the longitudinal direction to form a plurality of longitudinal axis array groups (Ar1 . . . Arn) having a pitch M maintained between two adjacent ink-drop generators 22 in the longitudinal direction, and arranged in the horizontal direction to form a plurality of horizontal axis array groups (Ac1 . . . Acn) having a central stepped pitch P maintained between two adjacent ink-drop generators 22 in the horizontal direction. That is, as shown in FIG. 5, the pitch M is maintained between the ink-drop generator 22 with the coordinate (Ar1, Ac1) and the ink-drop generator 22 with the coordinate (Ar1, Ac2). Moreover, the central stepped pitch P is maintained between the ink-drop generator 22 with the coordinate (Ar1, Ac1) and the ink-drop generator 22 with the coordinate (Ar2, Ac1). The resolution number of dots per inch (DPI) for the inkjet chip 21 is equal to 1/(the central stepped pitch P). Therefore, in order to achieve the required higher resolution, a layout design with a resolution of at least 600 DPI is utilized in the present disclosure. Namely, the central stepped pitch P is at least equal to $1/600$ inches or less. Certainly, the resolution DPI of the inkjet chip 21 in the present disclosure can also be designed with at least 600 DPI to 1200 DPI. That is the central stepped pitch P is equal to at least $1/600$ inches to $1/1200$ inches. Preferably but not exclusively, the resolution DPI of the inkjet chip 21 is designed with 720 DPI, and the central stepped pitch P is at least equal to $1/720$ inches or less. Preferably but not exclusively, the resolution DPI of the inkjet chip 21 in the present disclosure is designed with at least 1200 DPI to 2400 DPI. That is, the central stepped pitch P is equal to at least $1/1200$ inches to $1/2400$ inches. Preferably but not exclusively, the resolution DPI of the inkjet chip 21 in the present disclosure is designed with at least 2400 DPI to 24000 DPI. That is, the central stepped pitch P is equal to at least $1/2400$ inches to $1/24000$ inches. Preferably but not exclusively, the resolution DPI of the inkjet chip 21 in the present disclosure is designed with at least 24000 DPI to 48000 DPI. That is, the central stepped pitch P is equal to at least $1/24000$ inches to $1/48000$ inches.

In the embodiment, the inkjet chip 21 disposed on the wafer structure 2 has a printing swath Lp, which is more than 0.25 inches. Preferably but not exclusively, the printing swath Lp of the inkjet chip 21 ranges from at least 0.25 inches to 0.5 inches. Preferably but not exclusively, the printing swath Lp of the inkjet chip 21 ranges from at least 0.5 inches to 0.75 inches. Preferably but not exclusively, the printing swath Lp of the inkjet chip 21 ranges from at least 0.75 inches to 1 inch. Preferably but not exclusively, the printing swath Lp of the inkjet chip 21 ranges from at least 1 inch to 1.25 inches. Preferably but not exclusively, the printing swath Lp of the inkjet chip 21 ranges from at least 1.25 inches to 1.5 inches. Preferably but not exclusively, the printing swath Lp of the inkjet chip 21 ranges from at least 1.5 inches to 2 inches. Preferably but not exclusively, the printing swath Lp of the inkjet chip 21 ranges from at least 2 inches to 4 inches. Preferably but not exclusively, the printing swath Lp of the inkjet chip 21 ranges from at least 4 inches to 6 inches. Preferably but not exclusively, the printing swath Lp of the inkjet chip 21 ranges from at least 6 inches to 8 inches. Preferably but not exclusively, the printing swath Lp of the inkjet chip 21 ranges from at least 8 inches to 12 inches. Preferably but not exclusively, the printing swath Lp of the inkjet chip 21 is 8.3 inches, and 8.3 inches is the page width of the A4-size paper, so that the inkjet chip 21 is provided with the page width print function on the A4-size paper. Preferably but not exclusively, the printing swath Lp of the inkjet chip 21 is 11.7 inches, and 11.7 inches is the page width of the A3-size paper, so that the inkjet chip 21 is provided with the page width print function on the A3-size paper. Preferably but not exclusively, the printing swath Lp of the inkjet chip 21 is equal to or greater than at least 12 inches. In the embodiment, the inkjet chip 21 disposed on the wafer structure 2 has a width W, which ranges from at least 0.5 mm to 10 mm. Preferably but not exclusively, the width W of the inkjet chip 21 ranges from at least 0.5 mm to 4 mm. Preferably but not exclusively, the width W of the inkjet chip 21 ranges from at least 4 mm to 10 mm.

Figure 6:
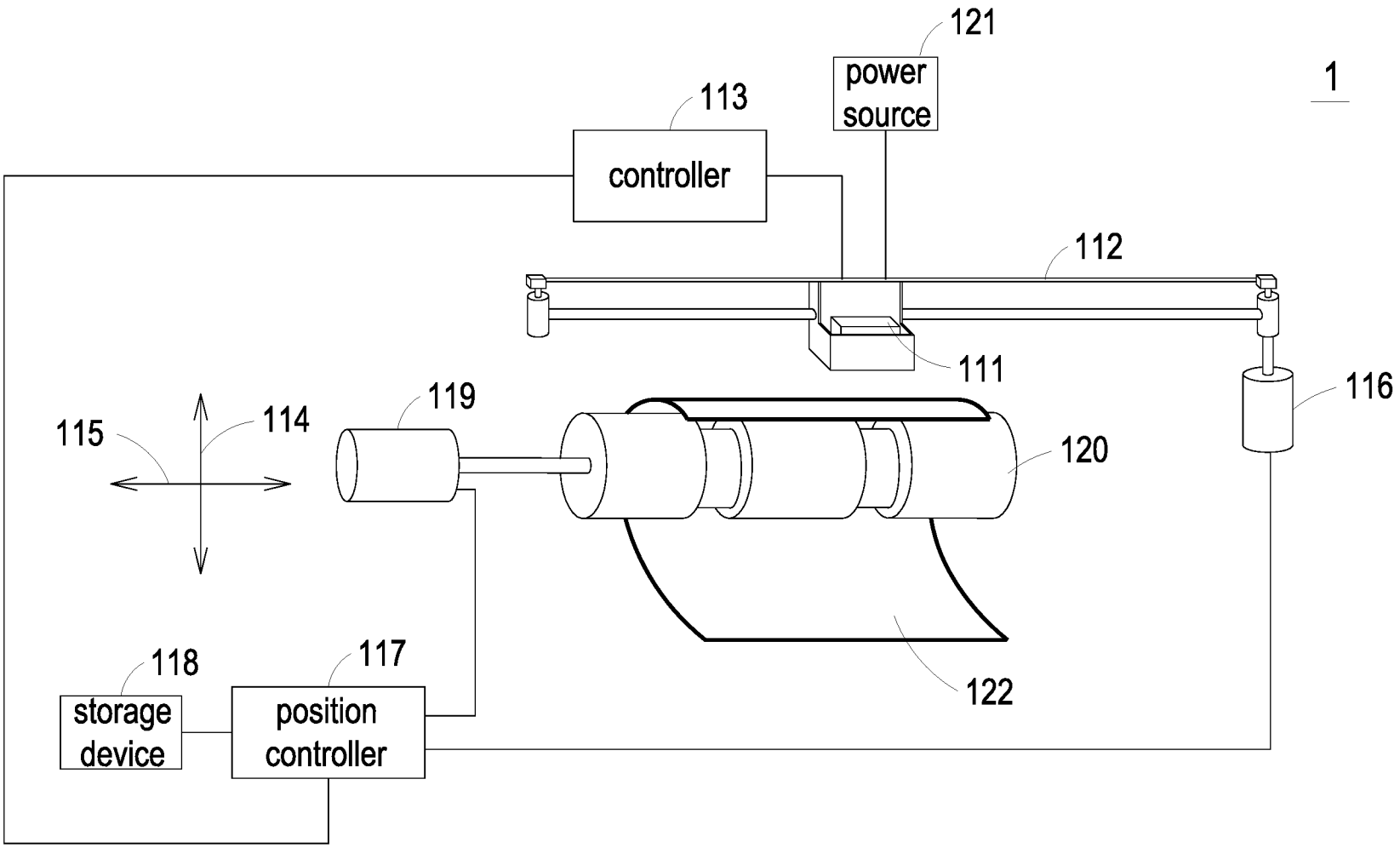
FIG. 6 is a schematic view illustrating an internal carrying system applied to an inkjet printer.

In the present disclosure, the wafer structure 2 including the chip substrate 20 and the plurality of inkjet chips 21 is provided. The chip substrate 20 is fabricated by the semiconductor process on a wafer of at least 12 inches or more, so that more required inkjet chips 21 are arranged on the chip substrate 20. Therefore, the plurality of inkjet chips 21 diced from the wafer structure 2 of the present disclosure can be used for inkjet printing of a printhead 111. Please refer to FIG. 6. In the embodiment, the carrying system 1 is mainly used to support the structure of the printhead 11I in the present disclosure. The carrying system 1 includes a carrying frame 112, a controller 113, a first driving motor 116, a position controller 117, a second driving motor 119, a paper feeding structure 120 and a power source 121. The power source 121 provides electric energy for the operation of the entire carrying system 1. In the embodiment, carrying frame 112 is mainly used to accommodate the printhead 111 and includes one end connected with the first driving motor 116, so as to drive the printhead 111 to move along a linear track in the direction of a scanning axis 115. Preferably but not exclusively, the printhead 111 is detachably or permanently installed on the carrying frame 112. The controller 113 is connected to the carrying frame 112 to transmit a control signal to the printhead 111. Preferably but not exclusively, in the embodiment, the first driving motor 116 is a stepping motor. The first driving motor 116 is configured to move the carrying frame 112 along the scanning axis 115 according to a control signal sent by the position controller 117, and the position controller 117 determines the position of the carrying frame 112 on the scanning axis 115 through a storage device 118. In addition, the position controller 117 is also configured to control the operation of the second driving motor 119 to drive the paper feeding structure 120 and feed the printing medium 122, such as paper, so as to allow the printing medium 122 to move along the direction of a feeding axis 114. After the printing medium 122 is positioned in the printing area (not shown), the first driving motor 116 is driven by the position controller 117 to move the carrying frame 112 and the printhead 111 along the scanning axis 115 for printing on the printing medium 122. After one or more scanning is performed along the scanning axis 115, the position controller 117 controls the second driving motor 119 to drive the paper feeding structure 120 and feed the printing medium 122. As a result, the printing medium 122 is moved along the feeding axis 114 to place another area of the printing medium 122 into the printing area. Then, the first driving motor 116 drives the carrying frame 112 and the printhead 111 to move along the scanning axis 115 for performing another line of printing on the printing medium 122. When all the printing data is printed on the printing medium 122, the printing medium 122 is pushed out to an output tray (not shown) of the inkjet printer, so as to complete the printing action.

In summary, the present disclosure provides a wafer structure including a chip substrate and a plurality of inkjet chips. The chip substrate is fabricated by a semiconductor process on a wafer of at least 12 inches or more, so that more inkjet chips required are arranged on the chip substrate. In addition, it prevents from limiting the size of the inkjet chips due to the insufficient size of the chip substrate. The use area of the chip substrate can be improved by using wafer equal to or greater than 12 inches, so as to reduce the vacancy rate and decrease the waste material on the wafer. The semiconductor waste is also reduced as the waste material is decreased, so as to achieve the goal of environmental-friendly. At the same time, the pursuit of printing quality for higher resolution and higher printing speed can be achieved, too.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A wafer structure, comprising:

a chip substrate, which is a silicon substrate, fabricated by a semiconductor process on a wafer of at least 12 inches; and at least one inkjet chip directly formed on the chip substrate by the semiconductor process and diced into at least one inkjet chip for inkjet printing, wherein the at least one inkjet chip includes:

at least one ink-supply channel configured to provide ink; and a plurality of ink-drop generators produced by the semiconductor process on the chip substrate and respectively connected to the at least one ink-supply channel, wherein each of the plurality of ink-drop generators comprises a thermal-barrier layer, a resistance heating layer, only one conductive layer, a protective layer, a barrier layer, an ink-supply chamber and a nozzle, wherein the conductive layer and a part of the protective layer are formed on the resistance heating layer, a rest part of the protective layer is formed on the conductive layer, the barrier layer is directly formed on the protective layer, the ink-supply chamber and the nozzle are integrally formed in the barrier layer, the ink-supply chamber has a bottom in communication with the protective layer, and a top in communication with the nozzle, wherein a diameter of the nozzle is in a range between 0.5 micrometers and 10 micrometers, and a volume of an inkjet drop discharged from the nozzle is in a range between 1 femtoliter and 3 picoliters, wherein in the at least one inkjet chip, the plurality of ink-drop generators are arranged in a longitudinal direction to form a plurality of longitudinal axis array groups having a pitch maintained between two adjacent ink-drop generators in the longitudinal direction, wherein the barrier layer includes two opposite inner sidewalls defining two opposite sides of the ink-supply chamber, each of the two opposite inner sidewalls of the barrier layer continuously extends from a respective one of two opposite sides of a top surface of a continuous portion of the protective layer toward the nozzle, the two opposite inner sidewalls of the barrier layer entirely and directly overlap with the conductive layer in a direction normal to the bottom of the ink-supply chamber, and the top surface of the continuous portion of the protective layer is the bottom of the ink-supply chamber, and wherein an ink supply path is formed between the at least one ink-supply channel and the ink-supply chamber of each of the plurality of ink-drop generators, and the ink supply path is configured to supply the ink from the at least one ink-supply channel to the ink-supply chamber in a plane parallel with the bottom of the ink supply chamber.

2. The wafer structure according to claim 1, wherein the chip substrate is fabricated by the semiconductor process on a 12-inch wafer.

3. The wafer structure according to claim 1, wherein the chip substrate is fabricated by the semiconductor process on a 16-inch wafer.

4. The wafer structure according to claim 1, wherein the thermal-barrier layer is formed on the chip substrate, the resistance heating layer is formed on the thermal-barrier layer.

5. The wafer structure according to claim 1, further comprising a conductor connected by the conductive layer fabricated by the semiconductor process of equal to or less than 90 nanometers to form an inkjet control circuit.

6. The wafer structure according to claim 5, wherein the conductor connected by the conductive layer is fabricated by the semiconductor process of 2 nanometers to 90 nanometers to form an inkjet control circuit.

7. The wafer structure according to claim 1, wherein the inkjet chip has a printing swath equal to or more than at least 0.25 inches, and the inkjet chip has a width ranging from at least 0.5 mm to 10 mm.

8. The wafer structure according to claim 7, wherein the printing swath of the inkjet chip ranges from at least 0.25 inches to 1.25 inches.

9. The wafer structure according to claim 7, wherein the printing swath of the inkjet chip ranges from at least 1.25 inches to 12 inches.

10. The wafer structure according to claim 7, wherein the printing swath of the inkjet chip is at least 12 inches.

11. The wafer structure according to claim 7, wherein the printing swath of the inkjet chip is 8.3 inches.

12. The wafer structure according to claim 7, wherein the printing swath of the inkjet chip is 11.7 inches.

13. The wafer structure according to claim 1, wherein in the at least one inkjet chip, the plurality of ink-drop generators are arranged in a horizontal direction to form a plurality of horizontal axis array groups having a central stepped pitch maintained between two adjacent ink-drop generators in the horizontal direction, wherein the central stepped pitch is at least equal to $1/600$ inches or less.

14. The wafer structure according to claim 13, wherein the central stepped pitch is equal to at least $1/600$ inches to $1/1200$ inches.

15. The wafer structure according to claim 14, wherein the central stepped pitch is equal to $1/720$ inches.

16. The wafer structure according to claim 13, wherein the central stepped pitch is equal to at least $1/1200$ inches to $1/2400$ inches.

17. The wafer structure according to claim 13, wherein the central stepped pitch is equal to at least $1/2400$ inches to $1/24000$ inches.

18. The wafer structure according to claim 13, wherein the central stepped pitch is equal to at least $1/24000$ inches to $1/48000$ inches.

19. A wafer structure, comprising:

a chip substrate, which is a silicon substrate, fabricated by a semiconductor process on a wafer of at least 12 inches; and at least one inkjet chip directly formed on the chip substrate by the semiconductor process and diced into at least one inkjet chip for inkjet printing, wherein the at least one inkjet chip includes a plurality of ink-drop generators produced by the semiconductor process on the chip substrate, and each of the plurality of ink-drop generators comprises a nozzle, wherein a diameter of the nozzle is in a range between 0.5 micrometers and 10 micrometers, and a volume of an inkjet drop discharged from the nozzle is in a range between 1 femtoliter and 3 picoliters, wherein in the at least one inkjet chip, the plurality of ink-drop generators are arranged in a longitudinal direction to form a plurality of longitudinal axis array groups having a pitch maintained between two adjacent ink-drop generators in the longitudinal direction, wherein each of the ink-drop generators comprises a thermal-barrier layer, a resistance heating layer, a conductive layer, a protective layer, a barrier layer and an ink-supply chamber, wherein the thermal-barrier layer is formed on the chip substrate, the resistance heating layer is formed on the thermal-barrier layer, the conductive layer and a part of the protective layer are formed on the resistance heating layer, a rest part of the protective layer is formed on the conductive layer, the barrier layer is formed on the protective layer, and the ink-supply chamber and the nozzle are integrally formed in the barrier layer, wherein the ink-supply chamber has a bottom in communication with the protective layer, and a top in communication with the nozzle, and wherein each of the first inkjet chip and the second inkjet chip comprises at least one ink-supply channel and a plurality of manifolds fabricated by the semiconductor process, wherein the ink-supply channel provides ink, and the ink-supply channel is in communication with the plurality of the manifolds, wherein the plurality of manifolds are in communication with each of the ink-supply chambers of the ink-drop generators.

20. A wafer structure, comprising:

a chip substrate, which is a silicon substrate, fabricated by a semiconductor process on a wafer of at least 12 inches; and at least one inkjet chip directly formed on the chip substrate by the semiconductor process and diced into at least one inkjet chip for inkjet printing, wherein the at least one inkjet chip includes a plurality of ink-drop generators produced by the semiconductor process on the chip substrate, and each of the plurality of ink-drop generators comprises a nozzle, wherein a diameter of the nozzle is in a range between 0.5 micrometers and 10 micrometers, and a volume of an inkjet drop discharged from the nozzle is in a range between 1 femtoliter and 3 picoliters, wherein in the at least one inkjet chip, the plurality of ink-drop generators are arranged in a longitudinal direction to form a plurality of longitudinal axis array groups having a pitch maintained between two adjacent ink-drop generators in the longitudinal direction, wherein each of the ink-drop generators comprises a thermal-barrier layer, a resistance heating layer, a conductive layer, a protective layer, a barrier layer and an ink-supply chamber, wherein the thermal-barrier layer is formed on the chip substrate, the resistance heating layer is formed on the thermal-barrier layer, the conductive layer and a part of the protective layer are formed on the resistance heating layer, a rest part of the protective layer is formed on the conductive layer, the barrier layer is formed on the protective layer, and the ink-supply chamber and the nozzle are integrally formed in the barrier layer, wherein the ink-supply chamber has a bottom in communication with the protective layer, and a top in communication with the nozzle, and, wherein the conductor connected by the conductive layer is a gate of a metal oxide semiconductor field effect transistor, or a gate of a complementary metal oxide semiconductor.

* * * * *